US008714814B2

(12) United States Patent
Altenhoven et al.

(10) Patent No.: US 8,714,814 B2
(45) Date of Patent: May 6, 2014

(54) DEVICE FOR LOCKING A TIMEPIECE MOVEMENT

(75) Inventors: Thierry Altenhoven, Delemont (CH); Carlo Albisetti, Courtelary (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 210 days.

(21) Appl. No.: 13/378,470

(22) PCT Filed: Jul. 8, 2010

(86) PCT No.: PCT/EP2010/059781

§ 371 (c)(1),
(2), (4) Date: Dec. 15, 2011

(87) PCT Pub. No.: WO2011/006818

PCT Pub. Date: Jan. 20, 2011

(65) Prior Publication Data

US 2012/0120779 A1 May 17, 2012

(30) Foreign Application Priority Data

Jul. 14, 2009 (EP) ..... 09165377

(51) Int. Cl.
*G04B 3/04* (2006.01)
*G04B 37/05* (2006.01)

(52) U.S. Cl.
USPC ..... 368/316; 368/308; 368/319

(58) Field of Classification Search
USPC ..... 368/300
See application file for complete search history.

(56) References Cited

U.S. PATENT DOCUMENTS

| | | | | |
|---|---|---|---|---|
| 2,974,474 | A * | 3/1961 | Wegner | 368/67 |
| 3,633,356 | A | 1/1972 | Kitazima et al. | |
| 4,152,889 | A * | 5/1979 | Sekiguchi | 368/290 |
| 4,536,095 | A | 8/1985 | Wuthrich et al. | |
| 5,644,553 | A | 7/1997 | Cuinet | |
| 6,322,246 | B1 * | 11/2001 | Leung | 368/299 |
| 6,575,619 | B1 * | 6/2003 | Stauffer | 368/299 |
| 2006/0114753 | A1 * | 6/2006 | Gerber | 368/295 |
| 2008/0225650 | A1 * | 9/2008 | Muller et al. | 368/310 |
| 2008/0273428 | A1 * | 11/2008 | Damasko | 368/295 |
| 2009/0073816 | A1 * | 3/2009 | Ozawa et al. | 368/294 |

FOREIGN PATENT DOCUMENTS

| | | |
|---|---|---|
| CH | 317954 | 12/1956 |
| DE | 103 47 048 | 5/2005 |
| JP | 55 069770 | 5/1980 |
| WO | 96 25694 | 8/1996 |

OTHER PUBLICATIONS

International Search Report issued on Oct. 7, 2010 in PCT/EP2010/059781 filed on Jul. 8, 2010.

* cited by examiner

*Primary Examiner* — Amy Cohen Johnson
*Assistant Examiner* — Matthew Powell
(74) *Attorney, Agent, or Firm* — Oblon, Spivak, McClelland, Maier & Neustadt, L.L.P.

(57) ABSTRACT

A timepiece including a case including a middle part, which is closed on the top portion thereof by a bezel and on the bottom portion by a back cover, and a timepiece movement mounted against the middle part by a casing ring. The timepiece also includes a locking device for pressing the assembly including the timepiece movement and casing ring against the middle part when the case of the timepiece is closed.

11 Claims, 5 Drawing Sheets

DEVICE FOR LOCKING A TIMEPIECE MOVEMENT

FIELD OF THE INVENTION

The invention relates to a device for locking a timepiece movement and more specifically, a device of this type for locking a self-winding mechanical movement.

BACKGROUND OF THE INVENTION

For fixedly mounting a mechanical timepiece movement, it is known to use screws and/or clamps to lock said movement relative to the middle part of the timepiece. This solution may be unsatisfactory if compactness and/or fabrication of a timepiece at a reasonable cost are desired.

SUMMARY OF THE INVENTION

It is an object of the present invention to overcome all of part of aforecited drawbacks by proposing a timepiece including a locking device which has no screws and/or clamps and allows simplified assembly of the timepiece.

The invention therefore relates to a timepiece including a case comprising a middle part, which is closed, on the top portion thereof by a bezel and on the bottom portion by a back cover, a timepiece movement mounted against the middle part by means of a casing ring, push buttons for controlling said timepiece movement and including a stem received in a hole in the middle part and connected to a head outside the middle part, a locking device for pressing the assembly comprising the timepiece movement—casing ring against the middle part when the timepiece case is closed and including an annular part, the surface of which faces the casing ring and includes recesses to match raised portions made on said casing ring, characterized in that at least one of the recesses in the annular part forms a clamp for the stem of one of said push buttons, so as to retain the flared end of said stem between the annular part and the timepiece movement.

Advantageously according to the invention, the timepiece assembly includes a minimal number of parts and can thus be more easily adapted to fabrication variations in the various components, while remaining high tech, with, in particular, a chronograph, a date, a mechanical movement, a transparent back cover and a plastic middle part.

In accordance with other advantageous features of the invention:

- the flared portion of the stem is formed by a recess in the body of the stem;
- the annular part includes two grooves made in the internal surface thereof so as to offer a recess for the flared end of each stem;
- each push button is elastically mounted against the middle part by means of a spring arranged between the middle part and the back of the push button head;
- the annular part is mounted between the casing ring and the back cover of the case;
- the annular part includes plastic deformation areas which cooperate with the back cover of the case and/or the casing ring to compensate for any fabrication variations in the timepiece by upsetting deformation or squeezing;
- the deformation areas include surplus material projecting from the annular part;
- the casing ring includes a positioning catch for cooperating with a recess in the middle part so as to orient the timepiece movement relative to the middle part in a reliable manner;
- the timepiece movement is a mechanical chronograph.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Figure 1:
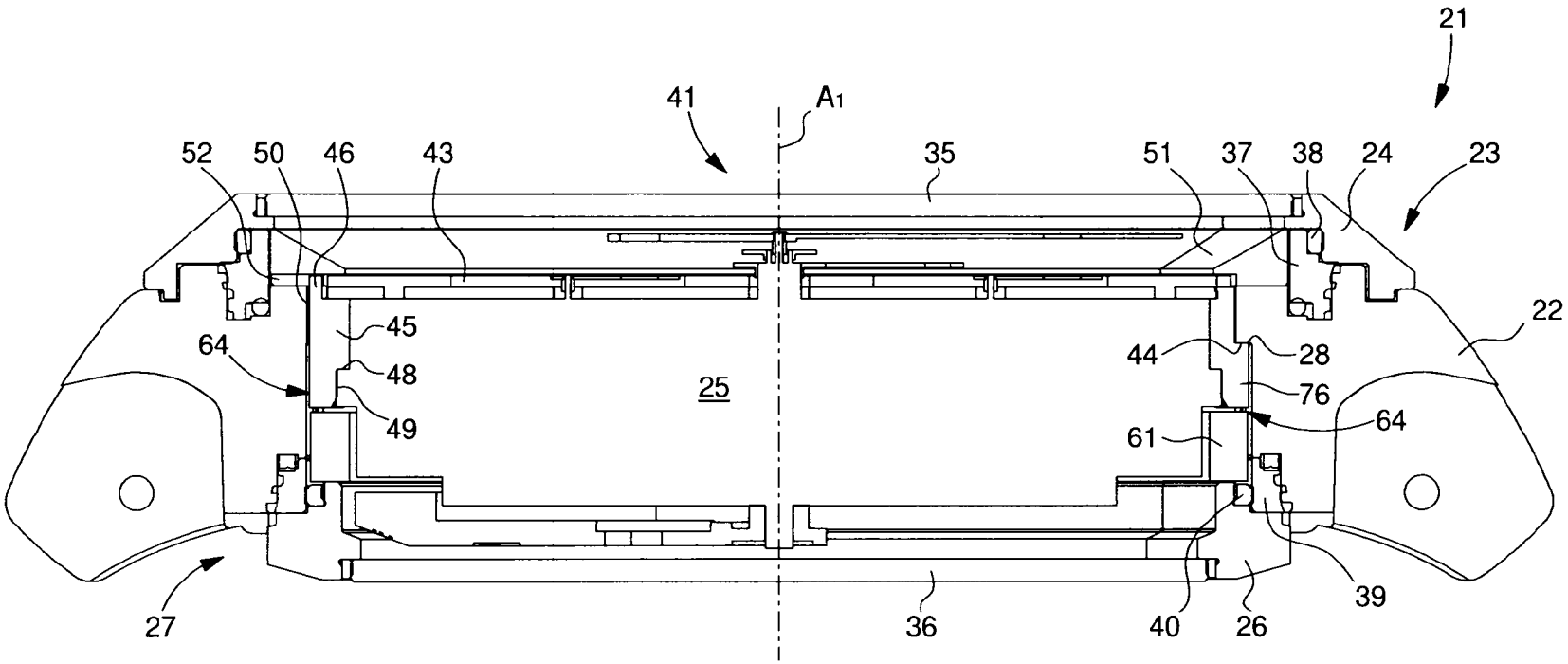
FIG. 1 is a cross-section of the timepiece according to the invention.
Figure 2:
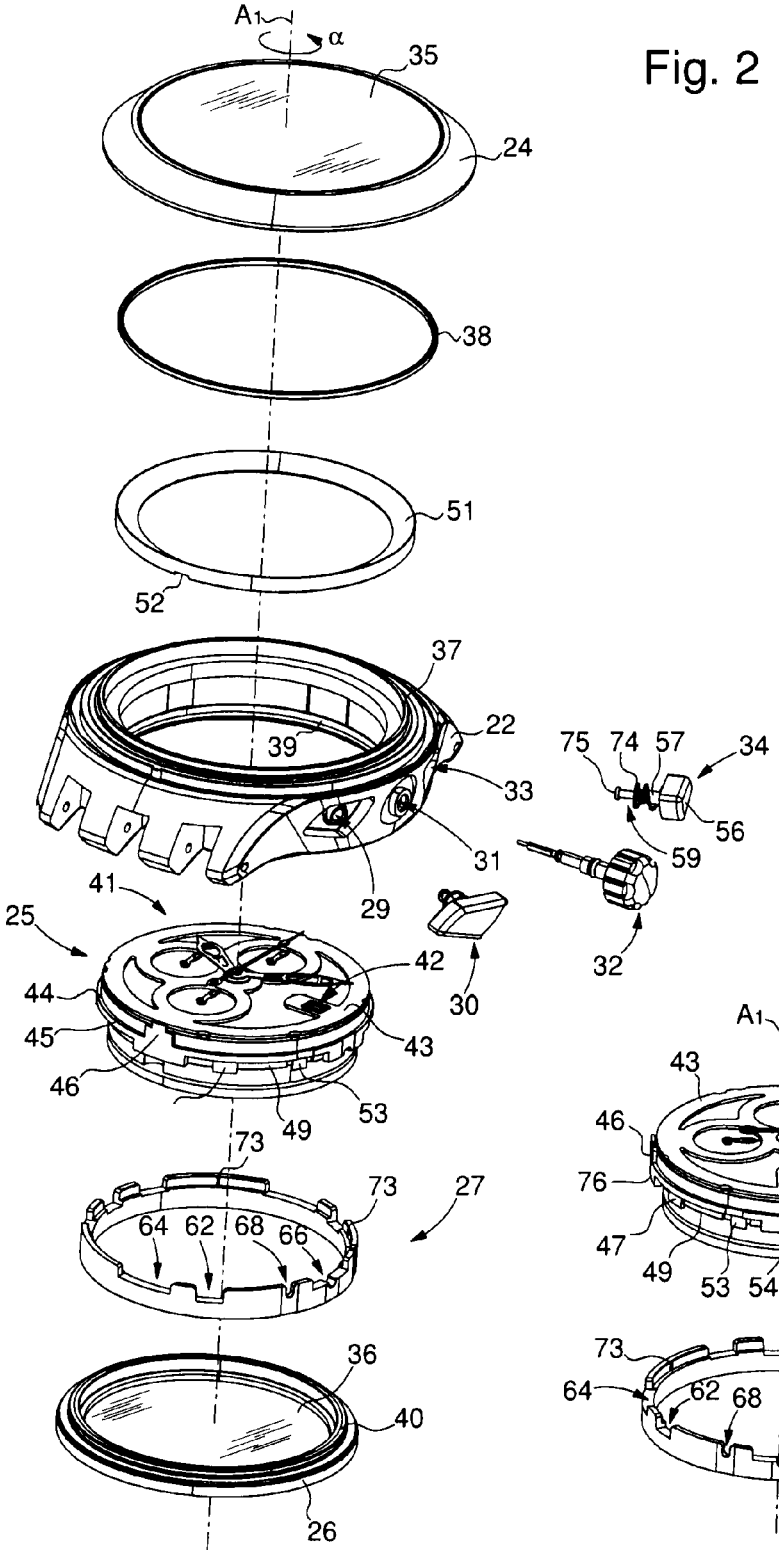
FIG. 2 is an exploded perspective view of the main components of the timepiece according to the invention.

FIG. 1 shows a cross-section of a timepiece generally referenced 21. It mainly includes a case 23, a timepiece movement 25 and a locking device 27. Case 23 includes a middle part 22, the top portion of which is closed by a bezel 24 and the bottom portion of which is closed by a back cover 26. Middle part 22 is for receiving the timepiece movement 25 by means of at least one shoulder 28 made in the internal wall thereof. As illustrated in FIG. 2, it is also seen that middle part 22 includes holes 29, 33, 31 for receiving the stems of push buttons 30, 34 and of crown 32 respectively.

Stem 22 is preferably made of plastic material. However, any other type of material can be envisaged such as, for example, a metal or ceramic.

According to the invention, bezel 24 and back cover 26 are made of metal and each include a crystal 35, 36. Preferably, bezel 24 and back cover 26 are driven onto middle part 22 by means of rings 37, 39, which are preferably made of metal. Each ring 37, 39 cooperates respectively with bezel 24 and back cover 26 by means of a gasket 38, 40 improving both the sealing and securing of said rings. Of course, if middle part 22 is not made of plastic, but for example, of metal, these rings 37 and 39 are no longer necessary.

Figure 3:
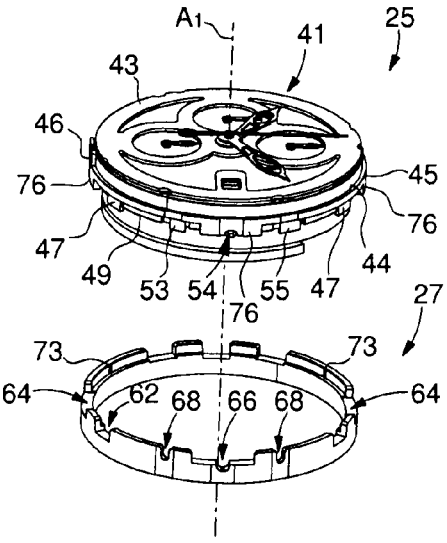
FIG. 3 is a partial diagram of FIG. 2 where the orientation has been altered.

Movement 25 is preferably mechanical and includes date and chronograph functions with three strokes, this latter function being controlled by push buttons 30, 34. As illustrated in FIGS. 2 and 3, the top of movement 25 includes hands 41 and a multi-level dial 43 provided with a date aperture 42. In the example illustrated in FIGS. 2 and 3, the timepiece movement 25 includes six hands 41 which can represent, for example, the seconds, minutes and hours of the time and the time measured by the chronograph.

As seen in FIGS. 1, 2, 3 and 5, movement 25 is mounted on shoulder 28 of middle part 22 via a casing ring 45. Consequently, casing ring 45 is intended to make movement 25 fit against the internal wall of middle part 22. Casing ring 45 includes an overall annular body, the external wall of which includes at least one shoulder 44 and a positioning catch 46, and the internal wall of which includes at least one shoulder 48 and at least one securing hook 47.

Figure 5:
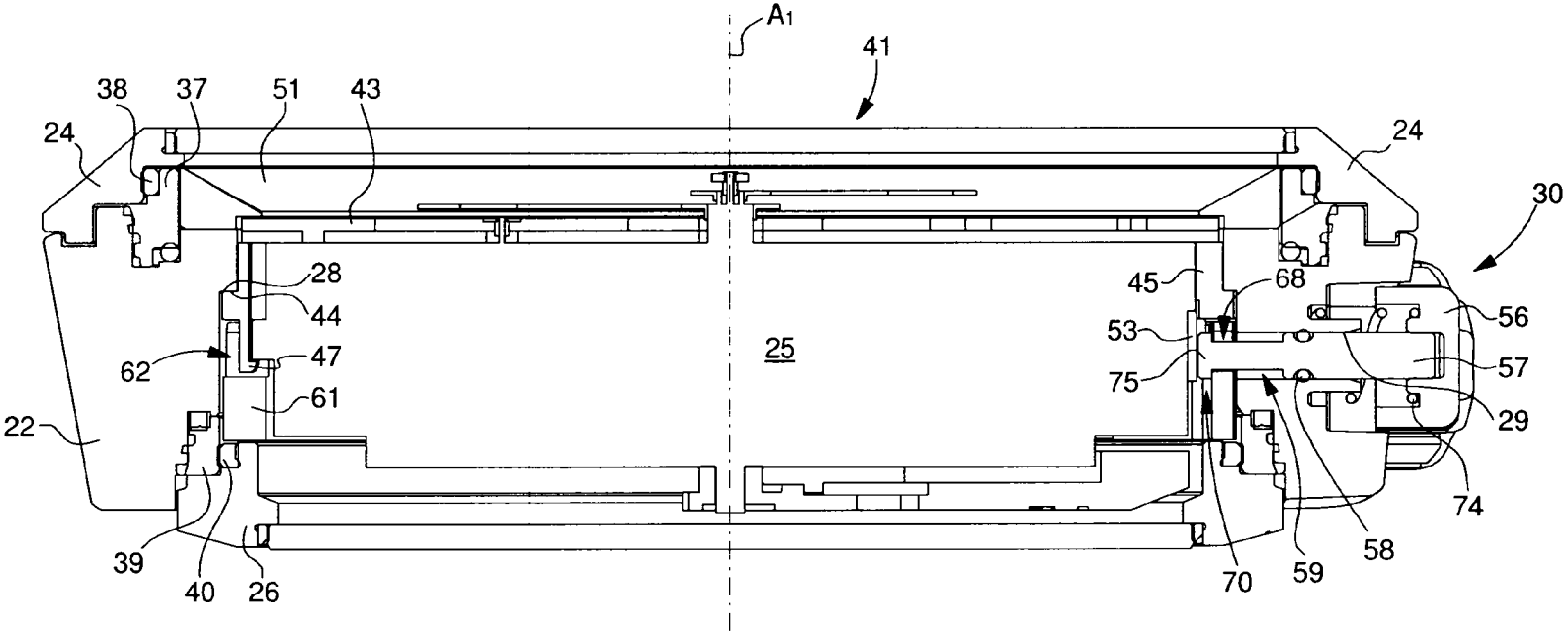
FIG. 5 is a cross-section of the timepiece oriented along the activation axis of one of the push buttons.

As illustrated in FIGS. 2, 3 and 5, casing ring 45 is attached against movement 25 by the interaction of each hook 47 against the bottom portion of the thread 49 of movement 25 and of each shoulder 48 against the top portion of said thread 49.

As seen in FIG. 1, each shoulder 44 is intended to enter into contact with the shoulder 28 of middle part 22. This contact allows the height of casing ring 45, and thus of movement 25, to be adjusted relative to middle part 22. Moreover, casing ring 45 is preferably hollowed out to free space around the mechanical control members 53, 55 of the chronograph and the hole 54 for controlling the time-setting device and, where appropriate, the date device.

As seen in FIGS. 2 and 5, push buttons 30 and 34 are intended to move the mechanical control members 53 and 55 respectively. Each push button 30, 34 includes a head 56 connected to a stem 57. Preferably, each push button 30, 34 is elastically mounted on middle part 22 via a spring 74 assembled concentrically between each hole 29, 33 in middle part 22 and the back of each head 56. Preferably, stem 57 includes a first annular recess for receiving a sealing gasket 58 and a second annular recess 59 for cooperating with a part 61, as explained hereinafter. As illustrated in FIGS. 2 and 5, the second recess 59 forms one end 75 of stem 57, which is flared.

Finally, positioning catch 46 is present in the extension of the base of said at least one shoulder 44. As illustrated in FIGS. 1 to 3, catch 46 is for cooperating with a recess 50 of matching shape made in the internal wall of middle part 22. This configuration thus reliably orients angle a along the vertical axis A1 of casing ring 45, and thus of movement 25, relative to middle part 22.

Advantageously according to the invention, the timepiece 21 also includes a locking device 27 for pressing the assembly comprising timepiece movement 25—casing ring 45 against middle part 22 when back cover 26 of case 23 is closed. Locking device 27 includes an annular part 61, as illustrated in FIGS. 1 to 5. Annular part 61 includes surfaces 63, 65, 67, 69 respectively facing the assembly comprising casing ring 45—thread 49, the assembly comprising the internal wall of middle part 22—ring 39, the timepiece movement 25 and back cover 26.

Figure 4:
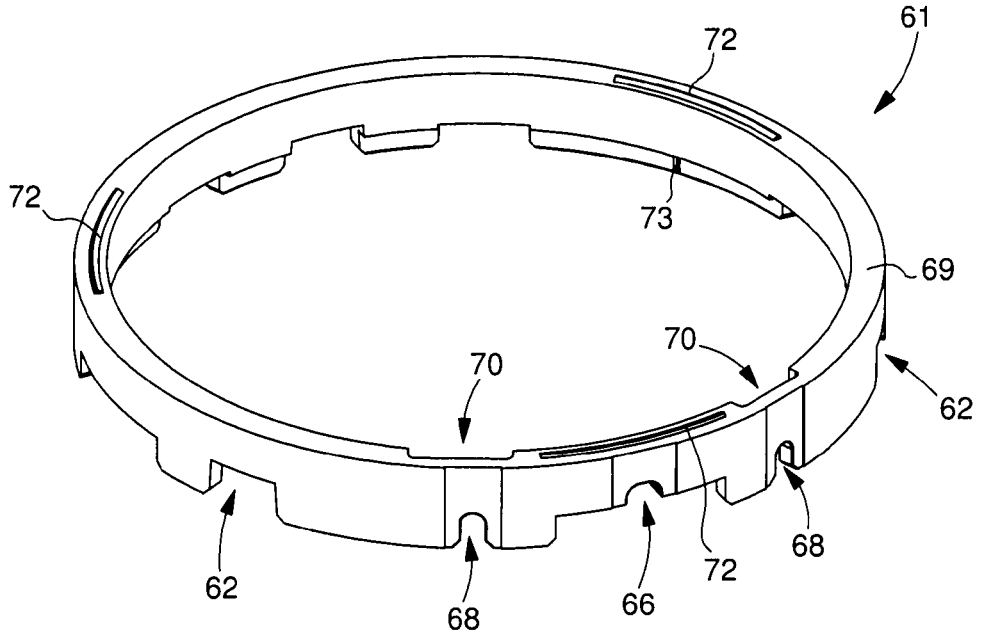
FIG. 4 is a perspective top and bottom view of one part of the locking device according to the invention.
Figure 4:
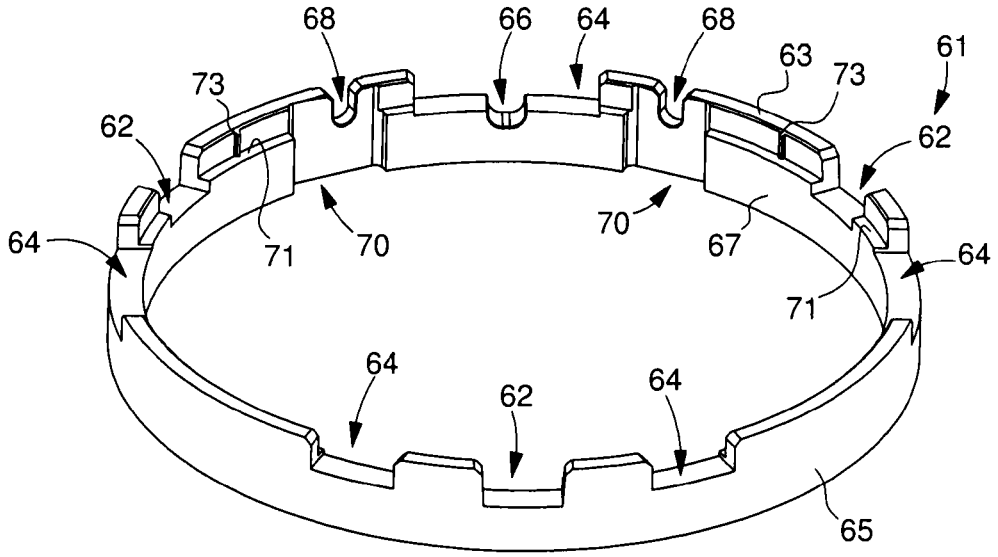

As illustrated in FIG. 4, surface 63 includes recesses 62, 64 intended to match the raised portions of casing ring 45. Thus, preferably, recesses 62 are made to prevent contact between annular part 61 and hooks 47 of casing ring 45. Moreover, preferably, recesses 64 are made to prevent contact between annular part 61 and thread 49 of movement 25, or each portion projecting from the bottom of casing ring 45 (in particular present at the base of catch 46). It is thus clear that annular part 61 is mounted against casing ring 45 on the top portion of surface 63 and shoulder 71 rests on the bottom of thread 49 of movement 25.

Surface 63 also includes recesses 68 and 66 for freeing space around the mechanical control members 53, 55 of the chronograph and control hole 54 of the time setting device, and where appropriate, the date device. It is thus clear that the recesses 68, 66 can receive the stems of push buttons 30, 34 and crown 32 respectively.

Moreover, advantageously according to the invention, each recess 68 is also intended to form a clamp by inserting each stem 57 of push button 30, 34 into the second annular recess 59. Annular part 61 therefore also includes two grooves 70 made in the internal surface 67 thereof to provide a recess for the flared end 75 of each stem 57.

The internal surface 67 of annular part 61 also includes shoulders 71 formed for freeing deformation areas 73. These areas, formed of projecting surplus material, are intended to cooperate with casing ring 45 so as to compensate for fabrication variations in timepiece 21 by upsetting deformation or squeezing.

Likewise, the bottom surface 69 of annular part 61 also includes deformation areas 72. These areas, formed of projecting surplus material, are intended to cooperate with the back of back cover 26 of case 23 so as to also compensate for fabrication variations in timepiece 21 by upsetting deformation or squeezing.

Upon reading the explanation hereinbefore, it is thus clear that annular part 61 is mounted between casing ring 45 and back cover 26 of case 23 and is, in particular, useful for its clamping function of the flared end 75 of each stem 57 of push button 30, 34.

Figure 6:
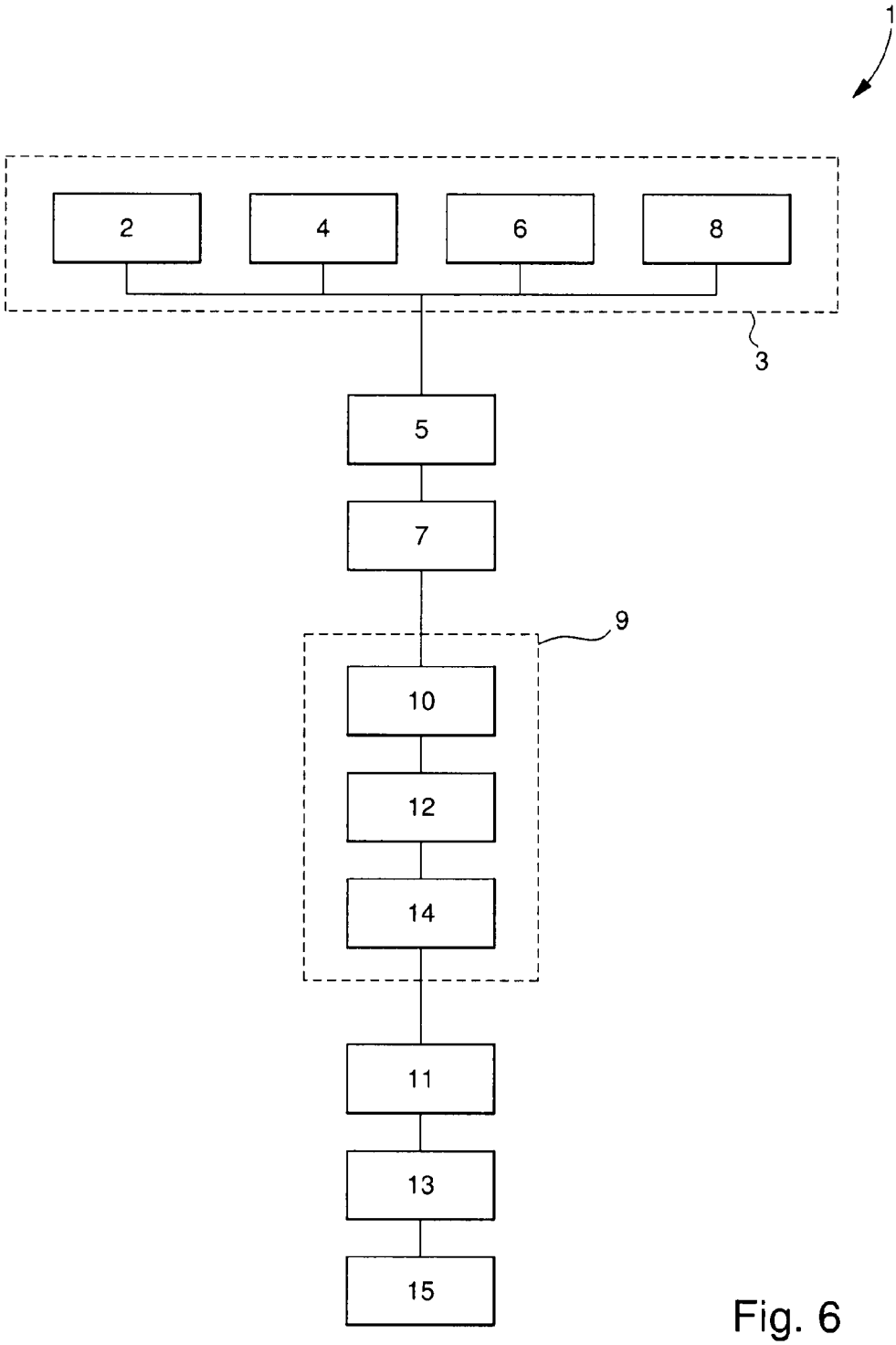
FIG. 6 is a flow diagram of the fabrication method of the timepiece according to the invention.

The method 1 of fabricating timepiece 21 will now be explained with reference to FIGS. 2 and 6. In a first step 3, the pre-assembly phases 2, 4, 6 and 8 of timepiece 21 are performed.

Thus, in phase 2, bezel 24 will be fabricated by assembling crystal 35, for example by means of a gasket. In phase 4, movement 25 will be fabricated by assembling casing ring 45, dial 43 and hands 41. In phase 6, back cover 26 will be fabricated by assembling a gasket 40 and middle part 36, for example using another gasket. In phase 8, middle part 22 will be fabricated by assembling rings 37, 39, for example by means of a gasket and holes 29, 31, 33.

In a second step 5 of method 1, the movement 25 prepared in phase 4 is slid inside the middle part 22, prepared in phase 8, until the respective shoulders 44 and 28 enter into contact. Advantageously according to the invention, the guiding in step 5 is improved by the interaction of positioning catch 46, present on casing ring 45, in recess 50 in the internal wall of middle part 22. As previously explained, at the end of step 5, casing ring 45 and thus movement 25 are positioned in middle part 22 at a predetermined angle a relative to axis A1 and a predetermined depth.

In a third step 7, crown 32 is mounted on movement 25 by passing, in succession, through hole 31 in middle part 22, the hollowed out portion of casing ring 45 and hole 54 in movement 25, in order to be attached thereto.

In a fourth step 9, the bezel 24 prepared in phase 2 is mounted on middle part 22 so as to close the top portion thereof. Step 9 thus includes a first phase 10 for placing the flange 51 against middle part 22, partially covering dial 43. Advantageously according to the invention, the guiding in phase 10 is improved by the interaction of positioning catch 46, present on casing ring 45, in groove 52 made on the base of flange 51. At the end of phase 10, flange 51 is positioned in middle part 22 at a predetermined angle $\alpha$ relative to axis A1 and a predetermined depth.

The fourth step 9 continues with the second phase 12 for placing gasket 38 against ring 37 of middle part 22 and then a third phase 14 for driving bezel 24 against ring 37 using gasket 38.

In a fifth step 11, push buttons 30, 34 are mounted against movement 25 by passing, in succession, through holes 29, 33 in middle part 22, and the hollowed out portion in casing ring 45, in order to face the control members 53 and 55 of movement 25.

The sixth step 13 of method 1 is for mounting annular part 61 against casing ring 45. The sixth step 13 is performed by countering the let down force of springs 74, in order to hold push buttons 30, 34 against control members 53, 55, then by sliding part 61 against the internal wall of middle part 22 until recesses 62, 64, 66, 68, 70 match the raised portions of casing ring 45 and the stems of push buttons 30, 34 and crown 32.

At the end of the sixth step 13, it is clear that push buttons 30, 34 are elastically mounted against middle part 22. Indeed, the stem 57 thereof is retained by the contact between the clamp, formed by recess 68 of part 61, and the flared end 75 of the stem. Further, part 61 is positioned in middle part 22 respectively at a predetermined angle a relative to axis A1 and a predetermined minimum depth.

The seventh and last step 15 is for closing the bottom portion of case 23, to press the assembly comprising timepiece movement 25—casing ring 45 against middle part 22. This is achieved by driving the back cover 26, prepared in phase 6, against the ring 39. Advantageously according to the invention, this step 15 also compensates for any fabrication variations in the various components. Indeed, as explained hereinbefore, when back cover 26 is pressed against ring 39, the deformation means 72, 73 will selectively be deformed by moving said back cover 26 closer to fit the final assembly to the actual dimensions of the timepiece, which vary because of fabrication variations. At the end of step 15, the fabrication of the timepiece is thus finished.

Of course, this invention is not limited to the illustrated example but is capable of various variants and alterations that will appear to those skilled in the art. In particular, the movement is not limited to a self-winding chronograph movement, and other types of movement including a thread 49 are possible.

It is also possible to envisage a case 23 which is partially closed, i.e. that has a back cover or a bezel in a single piece with the middle part. Thus, in the first case, the middle part could be replaced by a case which is held closed only by the bezel. Finally, in the second case, the middle part could be replaced by a case held closed only by the back cover.

The invention claimed is:

1. A timepiece including a case comprising:

a middle part, which is closed on a top portion thereof by a bezel and on a bottom portion by a back cover;

a timepiece movement mounted against the middle part by a casing ring;

push buttons for controlling the timepiece movement and including a stem having a flared end, said stem being received in a hole in the middle part and connected to a head outside the middle part;

a locking device for pressing an assembly comprising the timepiece movement and casing ring against the middle part when the case of the timepiece is closed, and including an annular part facing, on one side, the casing ring and, on another side, the back cover, wherein the annular part further includes recesses to match raised portions made on the casing ring, wherein at least one of the recesses in the annular part forms a clamp for a stem of one of the push buttons, so as to retain the flared end of the stem between the annular part and the timepiece movement.

2. The timepiece according to claim 1, wherein the flared portion of the stem is formed by a recess in the body of the stem.

3. The timepiece according to claim 1, wherein the annular part includes two grooves made in the internal surface thereof to provide a recess for the flared end of each stem.

4. The timepiece according to claim 1, wherein each push button is elastically mounted against the middle part by a spring arranged between the middle part and the back of the push button head.

5. The timepiece according to claim 1, wherein the annular part is mounted between the casing ring and the back cover of the case.

6. The timepiece according to claim 5, wherein the annular part includes plastic deformation areas that cooperate with the back cover of the case and/or the casing ring to compensate for any fabrication variations in the timepiece by upsetting deformation.

7. The timepiece according to claim 6, wherein the deformation areas include surplus material projecting from the annular part.

8. The timepiece according to claim 1, wherein the casing ring includes a positioning catch for cooperating with a recess in the middle part so as to orient the timepiece movement relative to the middle part in a reliable manner.

9. The timepiece according to claim 1, wherein the timepiece movement is of mechanical chronograph type.

10. The timepiece according to claim 1, wherein the locking device is free of any screw.

11. The timepiece according to claim 1, wherein the annular part is mounted against the casing ring and against the back cover, and wherein said annular part is configured to clamp the flared end of the stem of the push button.

* * * * *